US010994164B2

(12) United States Patent
Hren et al.

(10) Patent No.: US 10,994,164 B2
(45) Date of Patent: May 4, 2021

(54) FIRE APPARATUS VEHICLE WITH HIGH-FLOW ARTICULATED WATER TOWER

(71) Applicant: Seagrave Fire Apparatus, LLC, Clintonville, WI (US)

(72) Inventors: Davor Hren, Rijeka (HR); Damir Pinezic, Zagreb (HR); Charles Ptaschinski, Shawano, WI (US)

(73) Assignee: Seagrave Fire Apparatus, LLC, Clintonville, WI (US)

( * ) Notice: Subject to any disclaimer, the term of this patent is extended or adjusted under 35 U.S.C. 154(b) by 108 days.

(21) Appl. No.: 16/270,006

(22) Filed: Feb. 7, 2019

(65) Prior Publication Data

US 2019/0247687 A1 Aug. 15, 2019

Related U.S. Application Data

(60) Provisional application No. 62/628,468, filed on Feb. 9, 2018.

(51) Int. Cl.
*A62C 31/00* (2006.01)
*A62C 31/24* (2006.01)
*A62C 27/00* (2006.01)

(52) U.S. Cl.
CPC ..... *A62C 31/005* (2013.01); *A62C 27/00* (2013.01); *A62C 31/24* (2013.01)

(58) Field of Classification Search
CPC ..... A62C 31/005; A62C 27/00; A62C 31/24
USPC .... 169/24, 25; 239/159, 164, 165, 166, 169, 239/587.1, 587.2; 137/625.28
See application file for complete search history.

(56) References Cited

U.S. PATENT DOCUMENTS 3,346,052 A * 10/1967 Moore ..... A62C 31/24 169/25
3,599,722 A * 8/1971 Davidson ..... A62C 27/00 169/24
3,675,721 A 7/1972 Davidson et al.
3,770,062 A 11/1973 Riggs
4,007,793 A * 2/1977 Hux ..... A62C 31/24 169/25
4,453,672 A 6/1984 Garnett
5,211,245 A 5/1993 Relyea et al.
5,301,756 A 4/1994 Relyea et al.
5,437,345 A 8/1995 Schmidt et al.
5,788,158 A 8/1998 Relyea
6,755,258 B1 6/2004 Hunke et al.
(Continued)

FOREIGN PATENT DOCUMENTS

CN 103599611 2/2014

*Primary Examiner* — Steven J Ganey
(74) *Attorney, Agent, or Firm* — Boyle Fredrickson, S.C.

(57) ABSTRACT

A relatively small fire apparatus vehicle, which may have a single rear axle, is provided that includes a high-flow articulated water tower that delivers water at a rate of up to 1500 GPM (gallons per minute). The high-flow articulated water tower includes a water splitter that divides a water flow from a pump system into a pair of water flow path segments delivered through a pair of lower tower arm water pipes. The water flow path segments may be recombined in a water stem knuckle at a joint between the lower tower arm and an upper tower arm of the articulated water tower that is delivered as a combined flow through an upper tower arm water pipe and out a delivery nozzle.

15 Claims, 4 Drawing Sheets

(56) References Cited

U.S. PATENT DOCUMENTS

| | | | |
|---|---|---|---|
| 6,808,025 | B2 | 10/2004 | Bissen et al. |
| 7,389,826 | B2 | 6/2008 | Linsmeier et al. |
| 8,348,178 | B2 | 1/2013 | Svanebjerg et al. |
| 8,801,393 | B2 | 8/2014 | Crabtree et al. |
| 2008/0060822 | A1 | 3/2008 | Salmi et al. |
| 2017/0120286 | A1 | 5/2017 | Kestler |

* cited by examiner

FIRE APPARATUS VEHICLE WITH HIGH-FLOW ARTICULATED WATER TOWER

CROSS-REFERENCE TO RELATED APPLICATION

This application claims the benefit of U.S. Provisional Patent Application No. 62/628,468, filed on Feb. 9, 2018, the entirety of which is expressly incorporated by reference herein.

FIELD OF THE INVENTION

This invention relates generally to fire apparatus vehicles and, more particularly, to a high-flow articulated water tower for a fire apparatus vehicle.

BACKGROUND OF THE INVENTION

Known articulated water tower fire apparatus vehicles are designed with compromises between vehicle size and water flow rating. Smaller sized fire apparatus vehicles can be beneficial in many situations. These situations include urban uses because the smaller vehicles are more maneuverable through narrow streets than larger ones. Articulated water towers with higher water flow ratings are beneficial for firefighting because they can deliver more water for extinguishing fires than those with lower water flow ratings.

However, implementing high-flow articulated water towers, such as those with flow rates of about 1500 GPM (gallons per minute), on small fire apparatus vehicles is challenging. Vehicles with high-flow articulated water towers can experience large reactionary forces, which can be strong enough to make small fire apparatus vehicles unstable. Accordingly, typical fire apparatus vehicles that support high-flow articulated water towers are large vehicles with tandem rear axles or larger chassis. Many of the large fire apparatus vehicles also have at least two pairs of outriggers to further stabilize the large vehicles against the reactionary forces of the high-flow articulated water towers.

SUMMARY OF THE INVENTION

The present invention is directed to a relatively small fire apparatus vehicle, such as a single rear axle vehicle with a GVWR (gross vehicle weight rating) of less than 50 k pounds, that has a high-flow articulated water tower that can deliver water at a rate of up to 1500 GPM and which may have a single outrigger for stabilizing the vehicle.

According to one aspect of the invention, a fire apparatus vehicle includes a high-flow articulated water tower. The articulated water tower receives water from a pump system that is divided and delivered through a pair of pipes on opposite sides of the lower tower arm. A water stem knuckle is arranged at a joint between the lower tower arm and an upper tower arm. The water stem knuckle may receive the divided flow segments at opposite ends so that the flow segments flow axially toward each other, combine inside the water stem knuckle, and are released radially out of an intermediate portion of the water stem knuckle as a combined flow that is directed along the upper tower arm for delivery out of a nozzle at the end of the articulated water tower.

According to another aspect of the invention, a fire apparatus vehicle is provided that includes a vehicle chassis with a pair of chassis frame rails, a turret arranged above and supported by the vehicle chassis, and a high-flow articulated water tower. The high-flow articulated water tower is supported by the turret and is configured to deliver water. The high-flow articulated water tower includes a tower arm assembly and a delivery nozzle supported by the tower arm assembly. An arm water delivery system includes a water splitter that divides a volume of water flowing along the tower arm assembly into a pair of flow path segments as a divided water flow that flows along part of the tower arm assembly. A water flow combiner is downstream of the water splitter and upstream of the delivery nozzle. The water flow combiner joins the divided water flow's pair of flow path segments into a single volume of water or a combined water flow that flows toward the delivery nozzle.

According to another aspect of the invention, the tower arm assembly includes a folding tower arm system with lower and upper tower arms. The lower tower arm has an inner end that is pivot connected to the turret and an opposite outer end. The upper tower arm has an inner end that is pivot connected to the lower tower arm outer end at a folding tower arm joint. An outer end of the upper tower arm is arranged opposite the folding tower arm joint and supports the delivery nozzle.

According to another aspect of the invention, the water splitter includes an inlet that receives water from a pump system and a pair of outlets that delivers the divided water flow in a downstream direction. The water flow combiner may include a water stem knuckle defined at the folding tower arm joint. The water stem knuckle is configured to receive the divided water flow and deliver the combined water flow toward the delivery nozzle. The water stem knuckle may include a pair of inlets that receives the divided water flow and an outlet that delivers the combined water flow out of the water stem knuckle. A reinforcement cartridge within the water stem knuckle may have ribs that are arranged within a flow path through the water stem knuckle. The ribs may be arranged transversely with respect to longitudinal axes of the lower and upper tower arms. The reinforcement cartridge may include at least one opening that extends through its circumferential sidewall at an intermediate portion between its first and second ends. The reinforcement cartridge may include multiple openings, such as elongate slots, to define a perforated and substantially open intermediate portion. An outlet collar of the water stem knuckle may concentrically surround the reinforcement cartridge and ribs and has an outlet collar opening that defines the water stem knuckle outlet, which may be connected to the upper tower waterpipe that may extend longitudinally through an inside space of the upper tower arm.

According to another aspect of the invention, a pair of lower tower arm water pipes extends from the outlets of the water splitter. An upper tower arm water pipe extends from the outlet of the water stem knuckle and directs the combined water flow to the delivery nozzle.

Figure 1:
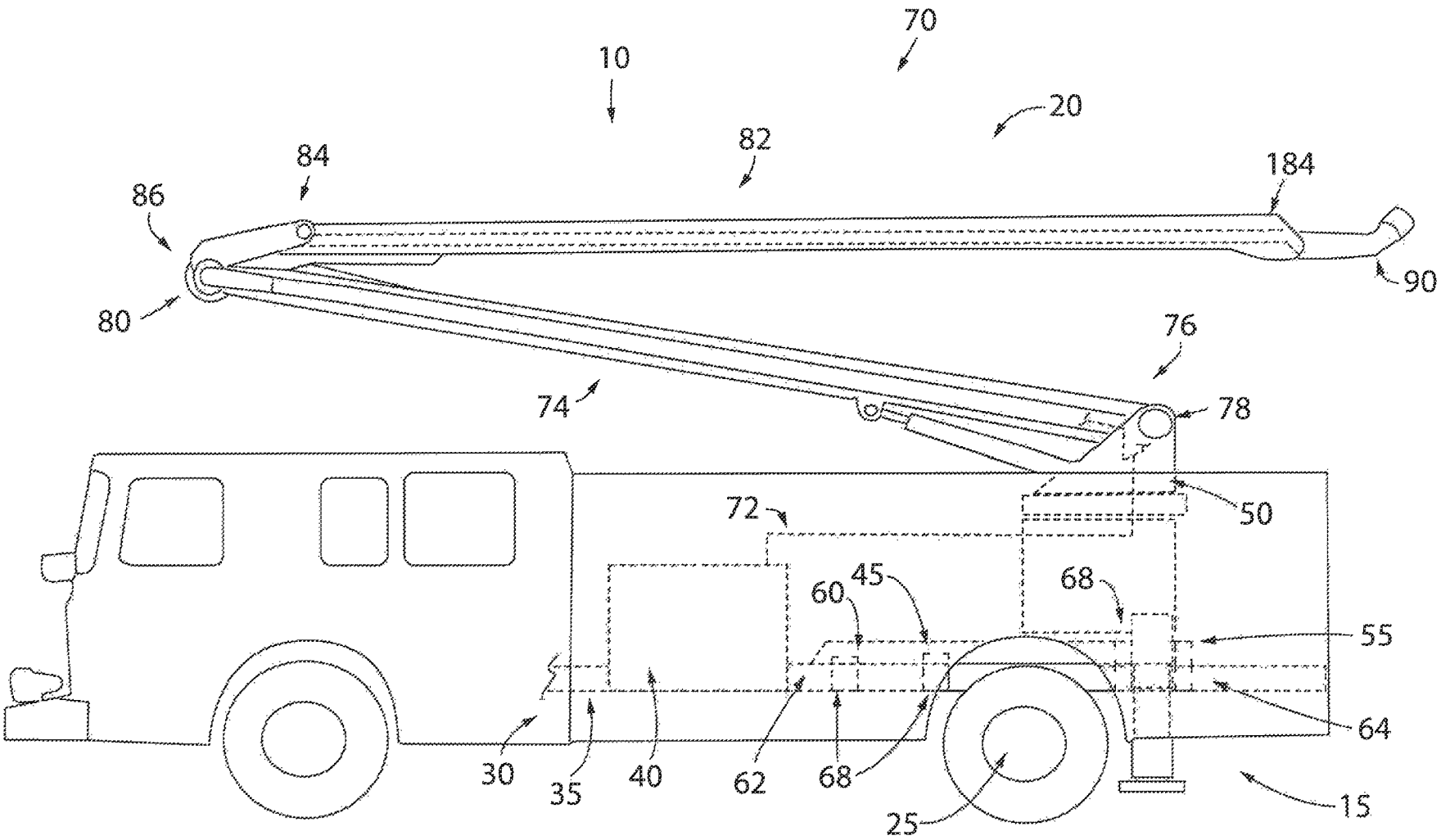
FIG. 1 is a side elevation of a fire apparatus vehicle with a high-flow articulated water tower of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a fire apparatus vehicle, represented as vehicle 10, implements a turret support arrangement 15 and a high-flow articulated water tower, shown as articulated water tower 20, that provide substantial vehicle stability while delivering a large volume of water, with a flow rate up to about 1500 GPM (gallons per minute) through the articulated water tower 20. Vehicle 10 is shown as a relatively small fire apparatus vehicle, which may have a GVWR (gross vehicle weight rating) of less than 50 k pounds. Vehicle 10 is shown here with a single rear axle 25 that is supported by a vehicle chassis 30 that has a pair of chassis frame rails 35 (only one shown). Chassis frame rails 35 also support the turret support arrangement 15, articulated water tower 20, a front axle, a cab, and other bodywork, components, and systems of vehicle 10, including pump system 40 that is configured to pump water to the high-flow articulated water tower 20 to be delivered from the vehicle 10.

Still referring to FIG. 1, turret support arrangement 15 includes torque box 45 that supports a tower-supporting turntable or turret 50 and can rotate about a vertical axis and supports the articulated water tower 20, and the turret support arrangement 15 also includes an outrigger system 55 that is configured to provide stability to the vehicle 10 and the articulated water tower 20 during use. Torque box 45 includes a pair of torque rails 60 (only one shown) arranged parallel to and above the pair of chassis frame rails 35. Torque rails 60 are shown here sitting on top of the chassis frame rails 35 and extending across rear axle 25, with a torque rail front end 62 in front of the rear axle 25 and torque rail back ends 64 behind the rear axle 25. Torque box mounts 68 are connect the torque rails 60 to the chassis frame rails at spaced-apart locations, shown here with two torque box mounts 68 in front of rear axle 25 and a single torque box mount 68 behind the rear axle 25 at each side of the vehicle 10. Tying the torque box 45 both in front of and behind the rear axle 25 in this way allows the mass of vehicle 10 in front of rear axle 25 to act as ballast that resists or counteracts at least some forces that are applied behind the rear axle 25 through the turret 50 during use of the high-flow articulated water tower 20.

Still referring to FIG. 1, articulated water tower 20 includes a folding tower arm system 70 with a tower arm assembly that has first and second arm segments configured to fold with respect to each other and an arm water delivery system 72 that is configured to convey water from the pump system 40 (FIG. 1) along the water tower 20. The folding tower arm system 70 includes a lower tower arm 74 with a lower tower arm inner end 76 that is pivot connected to the turret 50 at a turret-arm joint 78. A lower tower arm outer end 80 is arranged opposite the turret 50. Folding tower arm system 70 includes an upper tower arm 82 that has an upper tower arm inner end 84 that is pivot connected to the lower tower arm outer end 80 at a folding tower arm joint 86. An upper tower arm outer end 88 is arranged opposite the folding tower arm joint 86, and a delivery nozzle 90 is connected to the upper tower arm outer end 88.

Figure 2:
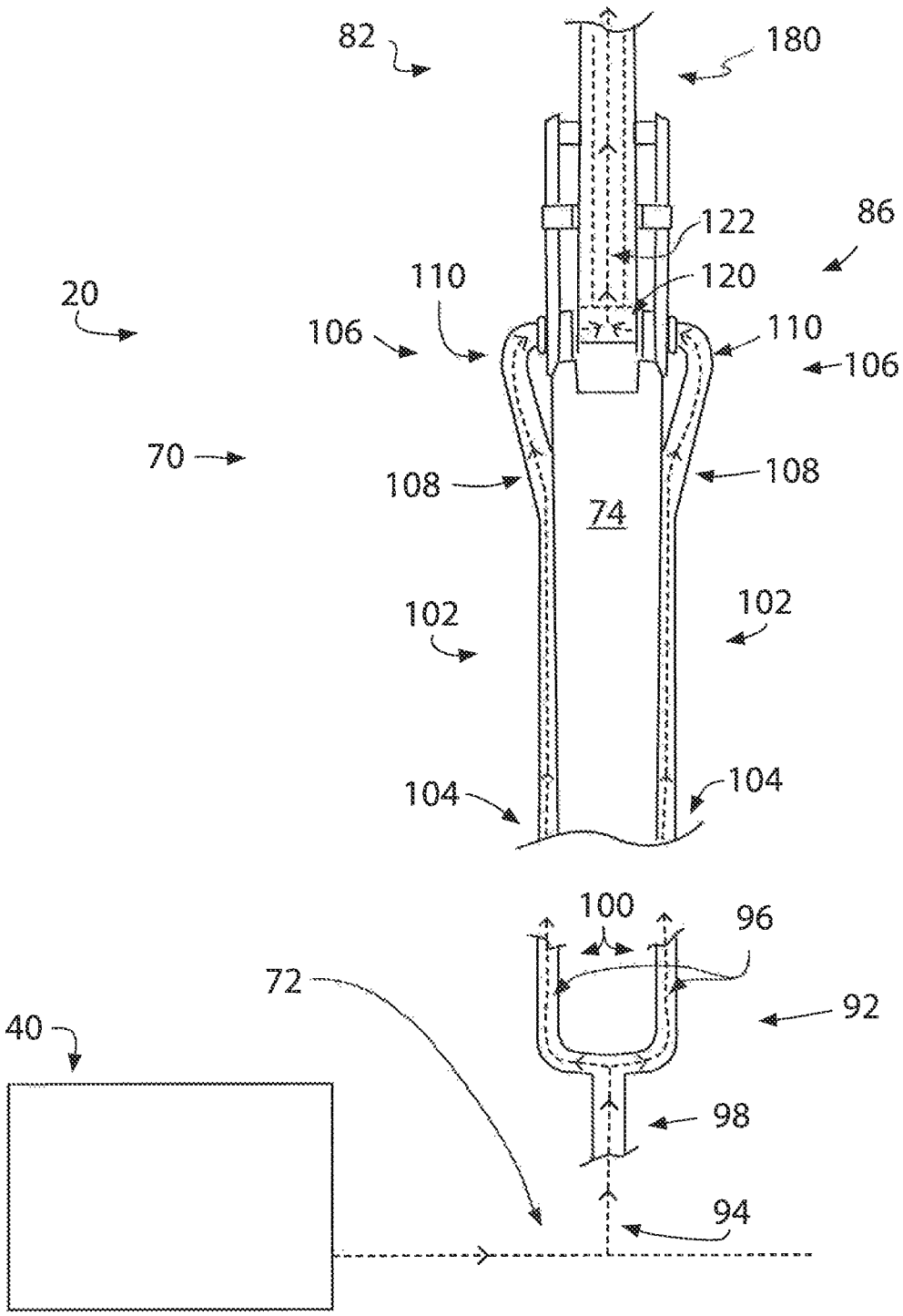
FIG. 2 is a partially schematic view of portions of the high-flow articulated water tower of FIG. 1.

Referring now to FIG. 2, arm water delivery system 72 includes a water splitter 92 for dividing a volume of flowing water 94 from the pump system 40 into a pair of divided water flow segments 96 that define a corresponding pair of flow path segments for delivery along the lower tower arm 74. The water splitter 92 includes an inlet 98 that receives the water from the pump system 40 and pair of outlets 100 that deliver the divided flow segments 96 in a downstream direction toward the lower tower arm 74. Lower tower arm water pipes 102 are supported on opposites sides of the lower tower arm 74 and have main body portions that are parallel to the lower tower 74. Each lower tower arm water pipe 102 has an inlet end 104 that is connected to a respective outlet 100 of the water splitter 92 and an outlet end 106 arranged opposite the water splitter 92. Each lower tower arm 74 carries a corresponding divided flow segment 96 downstream, away from the water splitter 92. Each outlet end 106 defines an angled segment 108 that extends angularly away from the main body portion of the respective lower tower arm water pipe 102 and the lower tower arm 74 and an elbow 110 that curves back toward the lower tower arm 74, generally perpendicular to the main body portion of the lower tower arm water pipe 102. End openings of the elbows 110 of the two lower tower arm water pipes 102 are axially aligned with and face each other, and each delivers its divided flow segment 96 into a water stem knuckle 120. The water stem knuckle 120 is arranged at the folding tower arm joint 86 and is shown defining a water flow combiner that is configured to combine the divided flow segments 96 into a combined water flow 122 that defines and travels along a combined flow path.

Figure 3:
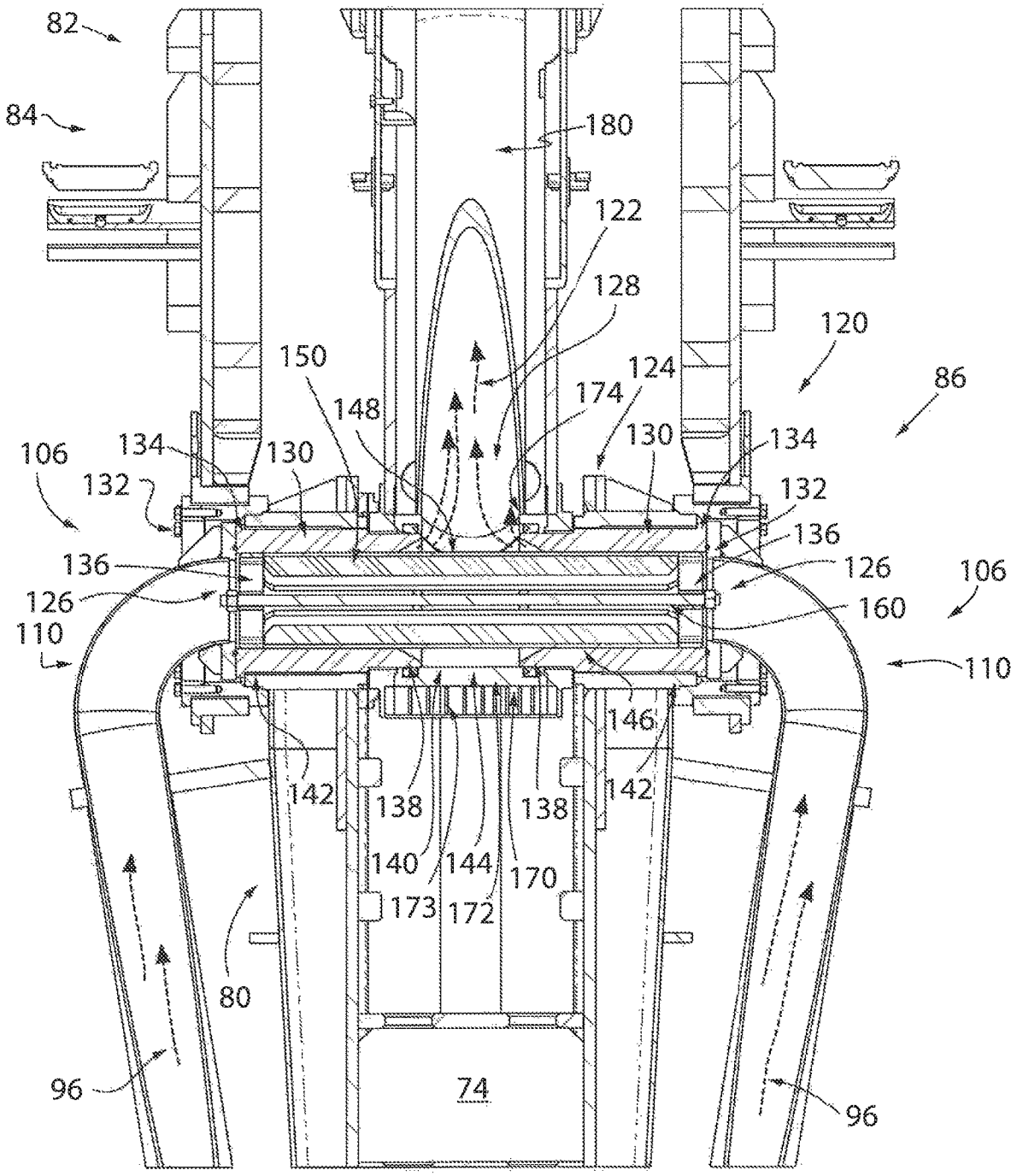
FIG. 3 is a cross-sectional view of a folding tower arm joint of the high-flow articulated water tower of FIG. 1.

Referring now to FIG. 3, the water stem knuckle 120 has a knuckle assembly 124 with a multi-piece configuration to allow for rotation of an intermediate segment with respect to outer segments and that has a pair of inlets 126 that receive the divided flow segments 96 from the lower tower arm water pipe outlet ends 106, and an outlet 128 delivers the combined water flow 122 in a downstream direction. The multi-piece configuration of knuckle assembly 124 includes a pair of hubs 130 that are fixed relative to the lower tower arm 74 and are arranged at opposites sides of the water stem knuckle 120. Hubs 130 are axially aligned with and longitudinally spaced from each other. Each of the hubs 130 has an outer end 132 with the radially extending flange 134 and a perforated end ring 136 with spoke-like divider walls that separate adjacent openings or passages and that fits concentrically inside of the outer end 132. Each end ring 136 has a central bore and multiple openings that extend longitudinally through it to provide the perforations that allow the water of the divided flow segment 96 to enter the hub 130. Inner ends 138 of hubs 130 have a reduced-diameter OD (outside diameter) compared to the hub's outer end 132. The hub's inner ends 138 have chamfered inner circumferential surfaces that transition to relatively wider openings facing the intermediate section of the water stem knuckle 120 interior.

Still referring to FIG. 3, a reinforcement cartridge 140 is arranged concentrically within and extends between the hubs 130. Cartridge 140 is generally tubular and partially perforated. Cartridge 140 has first and second outer ends 142 that concentrically nest within the interior of hubs 130 and an intermediate segment 144 that extends through the longitudinal gap between the ends of hubs 130. Cartridge 140 has a circumferential sidewall 146 that extends between the outer ends 142 and defines inner and outer surfaces. Openings 148 extend through the circumferential sidewall 146 at the intermediate segment 144 and define the perforations of the cartridge 140. The openings 148 may be large generally rectangular openings that extend substantially across the entire intermediate segment 144 and provide more open area of cartridge 140 at the intermediate segment 144 than closed material, defined by strips of the cartridge's 140 circumferential sidewall 146 between adjacent openings 148. Ribs 150 extend longitudinally with respect to cartridge 140, transversely with respect to the longitudinal axis of each of the lower and upper tower arms 74, 82, and radially inwardly from the inner circumferential surface of cartridge's 140 circumferential sidewall 146. This provides the cartridge 140 a generally cylindrical and internally gusseted configuration that guides the divided flow segments 96 axially toward each other to recombine in the intermediate segment and radially exit the cartridge 140. A fastener, shown as a threaded rod or screw bar 160 extends through the interior of water stem knuckle 120. Screw bar 160 is shown extending through the cartridge 140 and the central bores of the perforated end rings 136, with a nut at each end that secures the end relative to the perforated end ring 136 of the respective hub 130 to restrict axial movement of the hubs 130 away from each other.

Still referring to FIG. 3, knuckle assembly 124 includes a collar 170 that is fixed relative to the upper tower arm 82 and rotationally mounted relative to the hubs 130 and lower tower arm 74 so that the collar 170 moves in unison with the upper tower arm 82 as it pivots with respect to the lower tower arm 74 at the folding tower arm joint 86. Collar 170 has a circumferential side wall 172 that is arranged concentrically over the cartridge intermediate segment 144, between the ends of hubs 130, and overlies the cartridge openings 148 and the intermediate portions of ribs 150. Collar support ribs 173, shown edge-wise from above, are curved in profile to match the curvature of the collar's circumferential side wall 172 and are spaced from each other and arranged opposite the knuckle assembly outlet 128 to support the collar 170 from behind and resist reactionary forces of the combined water flow 122 that flows in the opposite direction. An inner surface of the collar circumferential sidewall 172 provides a boundary of a mixing or combining zone within the water stem knuckle 120 in which the divided flow segments 96 combine into the combined flow 122. An opening 174 through the collar circumferential sidewall 172 is shown here defining the water stem knuckle outlet 128 that delivers the combined flow 122 out of the water stem knuckle 120. The combined flow 122 is directed out of the knuckle outlet and into an upper tower arm water pipe 180 at its inlet end 182. Referring again to FIG. 1, upper arm water pipe 180 is shown arranged inside of the upper tower arm 82 and extends from inlet end 182 at the upper tower arm inner end 84 to an upper tower arm water pipe outlet end 184 (FIG. 1) at the upper tower arm outer end 88. The upper tower arm water pipe outlet end 184 is connected to the delivery nozzle 90 that delivers the water out of the articulated water tower 20.

Figure 4:
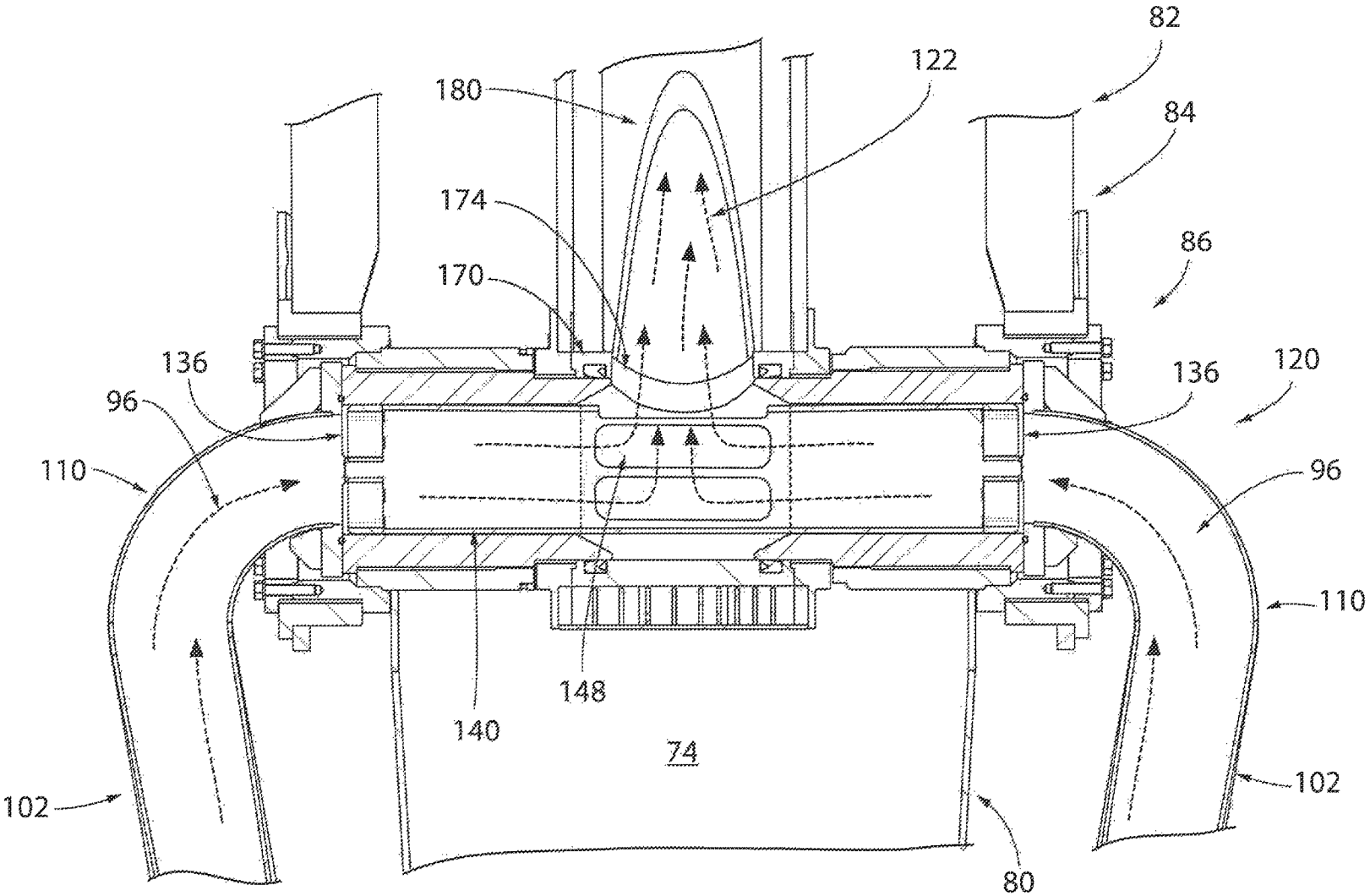
FIG. 4 is a simplified partial cross-sectional view of the folding tower arm joint of FIG. 3.

Referring now to FIG. 4, this simplified cross-sectional view shows the flow paths of the various water flow segments that merge in the water flow combiner of the folding tower arm joint 86, then are directed along the upper tower arm 82. Each divided flow segment 96 flows through its respective lower tower arm water pipe 102, changing direction in the elbow 110 from flowing generally parallel to the lower tower arm 74 to flowing substantially perpendicular with respect to the lower tower arm 74, being redirected to flow toward the folding tower arm joint 86. From the outlet of the elbow 110, each divided flow segment 96 flows through the passages of end ring 136 and into and through the longitudinal bore of the reinforcement cartridge 140. While flowing through the reinforcement cartridge 140, the ribs 150 (FIG. 3) help guide the divided flow segments 96 along a generally straight travel path toward the intermediate segment of the reinforcement cartridge 140, reducing turbulence that would otherwise be associated with a flow that is downstream of the direction change in elbow 110. At the intermediate segment of reinforcement cartridge 140, divided flow segments 96 axially collide with each other within this combiner of folding tower arm joint 86, which defines the mixing or combining zone within the water stem knuckle 120. From this location of mixing or recombining, the combined flow is forced radially out through the openings 148 of the reinforcement cartridge 140. The radially outwardly directed recombined flow is bounded at its sides by seal arrangements of the hubs 130 at the intermediate portion of the folding tower arm joint 86 and is circumferentially bounded by the inner circumferential surface of collar 170. Since collar 170 has a single opening 174, the entire volume of the combined flow 122 is directed out of the opening 174 and into the upper arm water pipe 180. In this way, the folding tower arm joint 86 is configured to direct water flows along a generally zig-zag or S-shaped redirection and flow combining path(s). The redirection and flow combining path(s) transversely move the spaced apart longitudinal flow paths of the divided flow segments 96 toward each other and force the recombination with each other to longitudinally flow along another longitudinal flow path of the combined flow 122, along a longitudinal flow path that extends along a line defined that is collinear with a center line between divided flow segments 96.

Many changes and modifications could be made to the invention without departing from the spirit thereof. The scope of these changes will become apparent from the appended claims.

What is claimed is:

1. A fire apparatus vehicle, comprising:

a vehicle chassis with a pair of chassis frame rails;

a turret arranged above and supported by the vehicle chassis; and a high-flow articulated water tower including:

a lower tower arm connected for articulation to the turret;

an upper tower arm connected for articulation to the lower tower arm;

an upper arm water pipe supported by the upper tower arm and configured to convey water along the upper tower arm;

a delivery nozzle supported by the upper tower arm and configured to receive water directed from the upper arm water pipe and configured to deliver water from the fire apparatus vehicle, the high-flow articulated water tower supported by the turret and directing a flow of water for delivery from the fire apparatus vehicle, wherein the flow of water defines:

a divided water flow segment that flows along a first portion of the high-flow articulated water tower;

a combined water flow segment that flows along a second portion of the high-flow articulated water tower downstream of the divided water flow segment.

2. The fire apparatus vehicle of claim 1, further comprising:

a water splitter for dividing a volume of water flowing along the tower arm assembly into a pair of flow path segments to define the divided water flow segment; and a water flow combiner arranged downstream of the water splitter and upstream of the delivery nozzle, the water flow combiner configured to combine the pair of flow path segments of the divided water flow into a single volume of water flowing toward the delivery nozzle as a combined water flow to define the combined water flow segment.

3. The fire apparatus vehicle of claim 2, wherein the tower arm assembly comprises:

a folding tower arm system that includes the lower tower arm and the upper tower arm, and wherein:

the lower tower arm includes a lower tower arm inner end that is pivot connected to the turret and a lower tower arm outer end arranged opposite the turret;

the upper tower arm includes an upper tower arm inner end that is pivot connected to the lower tower arm outer end at a folding tower arm joint that allows the lower tower arm and the upper tower arm to fold down in opposite directions of pivoting rotation and an upper tower arm outer end arranged opposite the folding tower arm joint that supports the delivery nozzle.

4. A fire apparatus vehicle, comprising:

a vehicle chassis with a pair of chassis frame rails;

a turret arranged above and supported by the vehicle chassis; and a high-flow articulated water tower configured to deliver water from the fire apparatus vehicle, the high-flow articulated water tower supported by the turret and directing a flow of water for delivery from the fire apparatus vehicle, wherein the flow of water defines:

a divided water flow segment that flows along a first portion of the high-flow articulated water tower;

a combined water flow segment that flows along a second portion of the high-flow articulated water tower downstream of the divided water flow segment;

a water splitter for dividing a volume of water flowing along the tower arm assembly into a pair of flow path segments to define the divided water flow segment; and a water flow combiner arranged downstream of the water splitter and upstream of a delivery nozzle, the water flow combiner configured to combine the pair of flow path segments of the divided water flow into a single volume of water flowing toward the delivery nozzle as a combined water flow to define the combined water flow segment; and wherein:

the water splitter comprises:

an inlet that receives water from a pump system supported by the vehicle chassis;

a pair of outlets that delivers the divided water flow in a downstream direction; and the water flow combiner comprises:

a water stem knuckle defined at the folding tower arm joint, wherein the water stem knuckle is configured to receive the divided water flow and deliver the combined water flow.

5. The fire apparatus vehicle of claim 4, wherein the water stem knuckle comprises:

a pair of inlets that receives the divided water flow; and an outlet that delivers the combined water flow in a downstream direction toward the delivery nozzle.

6. The fire apparatus vehicle of claim 5, wherein the water stem knuckle comprises:

a reinforcement cartridge with ribs that are arranged within a flow path of water flowing through the water stem knuckle.

7. The fire apparatus vehicle of claim 6, wherein the ribs are arranged transversely with respect to longitudinal axes of the lower and upper tower arms.

8. A high-flow articulated water tower for a fire apparatus vehicle that has a turret configured for rotating the high-flow articulated water tower about a generally vertical axis and a pump system configured to pump water to be delivered from the high-flow articulated water tower, the high-flow articulated water tower comprising:

a folding tower arm system that includes:

a lower tower arm that has a lower tower arm inner end that is pivot connected to the turret at a turret-arm joint and a lower tower arm outer end arranged opposite the turret;

an upper tower that arm has an upper tower arm inner end that is pivot connected to the lower tower arm outer end at a folding tower arm joint and an upper tower arm outer end arranged opposite the folding tower arm joint;

an arm water delivery system that includes:

a water splitter for dividing a volume of flowing water from the pump system into a pair of flow path segments to define a divided water flow for delivery along the lower tower arm, the water splitter including:

an inlet that receives water from the pump system; and a pair of outlets that delivers the divided water flow in a downstream direction;

a pair of lower tower arm water pipes with each lower tower arm pipe including an inlet end connected to a respective outlet of the water splitter and an outlet end arranged opposite the water splitter;

a water stem knuckle for combining the flow path segments of the divided water flow into a combined flow path that defines a combined water flow, the water stem knuckle including:

a pair of inlets that receives the divided water flow from the outlet ends of the lower tower arm water pipes; and an outlet that delivers the combined water flow in a downstream direction;

an upper tower arm water pipe that includes an inlet end connected to the water stem knuckle outlet and an outlet end arranged opposite the water stem knuckle; and a delivery nozzle that is connected to the upper tower arm water pipe outlet end for delivering the water out of the high-flow articulated water tower.

9. The high-flow articulated water tower of claim 8, wherein the water stem knuckle includes a reinforcement cartridge with first and second ends and that has:

a circumferential side wall that defines outer and inner surfaces and extends between the first and second ends; and ribs that extend in a longitudinal direction with respect to the reinforcement cartridge and radially outward from the circumferential sidewall outer surface.

10. The high-flow articulated water tower of claim 9, wherein the reinforcement cartridge includes at least one opening that extends through the circumferential sidewall at an intermediate portion between the first and second ends of the reinforcement cartridge, wherein the at least one opening is configured to deliver the combined water flow into the upper tower arm water pipe.

11. The high-flow articulated water tower of claim 10, wherein the reinforcement cartridge includes multiple openings that extend through the circumferential sidewall and are circumferentially spaced from each other.

12. The high-flow articulated water tower of claim 11, wherein the multiple openings define perimeter shapes that are elongate slots so that the circumferential sidewall defines a perforated segment of the reinforcement cartridge at the intermediate portion.

13. The high-flow articulated water tower of claim 8, wherein the water stem knuckle includes an outlet collar that concentrically surrounds the reinforcement cartridge and includes an outlet collar opening that defines the water stem knuckle outlet.

14. The high-flow articulated water tower of claim 13, wherein the water stem knuckle outlet collar is connected to the upper tower waterpipe.

15. The high-flow articulated water tower of claim 8, wherein the upper tower arm water pipe extends longitudinally through an inside space of the upper tower arm.

* * * * *